United States Patent [19]

Thompson

[11] Patent Number: 5,074,231

[45] Date of Patent: Dec. 24, 1991

[54] SEWING MACHINE AND SYNCHRONIZING ATTACHMENT THEREFOR

[76] Inventor: Elmer R. Thompson, 2408 47th St., Lubbock, Tex. 79412

[21] Appl. No.: 639,554

[22] Filed: Dec. 19, 1990

[51] Int. Cl.[5] ..... D05B 27/06

[52] U.S. Cl. ..... 112/311; 112/320

[58] Field of Search ..... 112/311, 320, 310, 314, 112/303, 323

[56] References Cited

U.S. PATENT DOCUMENTS

| | | | |
|---|---|---|---|
| 3,952,675 | 4/1976 | Thompson | 112/311 X |
| 4,296,703 | 10/1981 | Thompson | 112/310 |
| 4,323,020 | 4/1982 | Thompson | 112/61 |
| 4,341,172 | 7/1982 | Thompson | 112/310 |
| 4,449,464 | 5/1984 | Porter | 112/320 X |
| 4,611,548 | 9/1986 | Holl | 112/311 |
| 4,616,586 | 10/1986 | Scholl | 112/311 X |

*Primary Examiner*—Peter Nerbun

*Attorney, Agent, or Firm*—Laney, Dougherty, Hessin & Beavers

[57] ABSTRACT

A sewing machine includes, and can have attached thereto, a synchronizing apparatus by which a presser foot bar and a feed foot bar, and the respectively connected presser foot and feed foot, are lifted and lowered in synchronization with the vertical reciprocation of a needle bar to which a stitching needle is connected. A lift body is pivoted to both the presser foot bar and the feed foot bar. The lift body has an arcuate surface against which a roller connected to the needle bar acts to pivot the lift body alternately about the two connections. This provides appropriate lifting and lowering of the presser foot bar and the lift foot bar during a stitching cycle.

18 Claims, 3 Drawing Sheets

SEWING MACHINE AND SYNCHRONIZING ATTACHMENT THEREFOR

BACKGROUND OF THE INVENTION

This invention relates generally to sewing machines. In a more particular aspect, the present invention pertains to an attachment apparatus for synchronizing movements of a presser foot bar and a feed foot bar of a sewing machine with movement of a needle bar of the sewing machine.

Various sewing machine apparatus both for domestic use and commercial use have been developed. Conversion apparatus for converting a domestic sewing machine into one capable of feeding and stitching workpieces of extra thickness at cost substantially less than that required for the purchase of a commercial sewing machine have been developed as disclosed in my U.S. Pat Nos. 3,952,675; 4,296,703; 4,323,020 and 4,341,172. These conversion apparatus have feed mechanisms which grip both the top and bottom surfaces of the workpiece. These mechanisms have included the addition of a feed foot bar whose oscillation and reciprocation have had to be synchronized with other actions during a sewing cycle.

In my prior apparatus disclosed in the aforementioned patents, various means of operating the feed foot bar have been disclosed. Most of these have driven the feed foot bar with both feed and lift rods, but one embodiment shown in U.S. Pat. No. 3,952,675 (FIGS. 8 and 9) synchronizes the lifting of the feed foot bar and a presser bar with the rotation of a rotating cylinder or disk driving a needle bar. This requires a construction which accommodates the rotary motion of the rotating disk and the intervening motion of a link connecting the disk to the needle bar.

Despite the utility of my previous conversion apparatus, there is the need for an improved sewing machine, and attachment apparatus for a sewing machine, which more simply synchronizes the lifting and lowering of a feed foot bar and presser foot bar with the reciprocation of a needle bar.

SUMMARY OF THE INVENTION

The present invention provides a novel and improved sewing machine and attachment apparatus therefor, which apparatus more simply synchronizes movements of a presser foot bar and a feed foot bar of the sewing machine with movement of a needle bar of the sewing machine. The apparatus utilizes relatively few parts, thereby making for easier, less time-consuming and less costly manufacture. It requires relatively few adjustments, thereby making for more trouble free service. The apparatus can be adapted to many different models and makes of sewing machines, including both domestic and larger commercial types.

The attachment apparatus comprises: a lift body including a guide member; means for pivotally connecting the lift body to the presser foot bar and the feed foot bar so that the guide member is adjacent the needle bar; and actuator means, adapted for connection to the needle bar, for actuating the lift body in response to reciprocation of the needle bar. This apparatus further comprises biasing means for biasing the feed foot bar downward.

Such a apparatus for synchronizing movements of a presser foot bar and a feed foot bar with movement of a needle bar more particularly comprises: a double-lever body having defined therein: a central aperture for receiving a retaining screw to attach the body to the presser foot bar and to define a first fulcrum; an end slot for receiving a retaining screw to slidably attach the body to the feed foot bar and to define a second fulcrum; and a guide; and the apparatus also more particularly comprises a roller adapted to be connected to the needle bar so that the roller vertically reciprocates with the needle bar and rides along the guide of the double-lever body to pivot the double-lever body alternately about the first and second fulcrums and thereby alternately lift the feed foot bar and the presser foot bar.

The sewing machine in accordance with the present invention comprises: a needle bar; means for reciprocating the needle bar; a feed foot bar; means for oscillating the feed foot bar; a presser foot bar; and means for synchronizing movements of the feed foot bar and the presser foot bar with the reciprocation of the needle bar, which synchronizing means includes: a lift body connected to the feed foot bar and the presser foot bar; and actuator means, connected to the needle bar, for actuating the lift body in response to reciprocation of the needle bar.

Therefore, from the foregoing, it is a general object of the present invention to provide a novel and improved sewing machine and attachment apparatus therefor. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

U.S. Pat. Nos. 3,952,675; 4,296,703; 4,323,020 and 4,341,172 to Thompson are incorporated herein by reference.

The sewing machine of the present invention will be described with reference to FIGS. 1–4. The operation of a novel synchronizing apparatus of the sewing machine will be described with reference to FIGS. 4–7.

Figure 1:
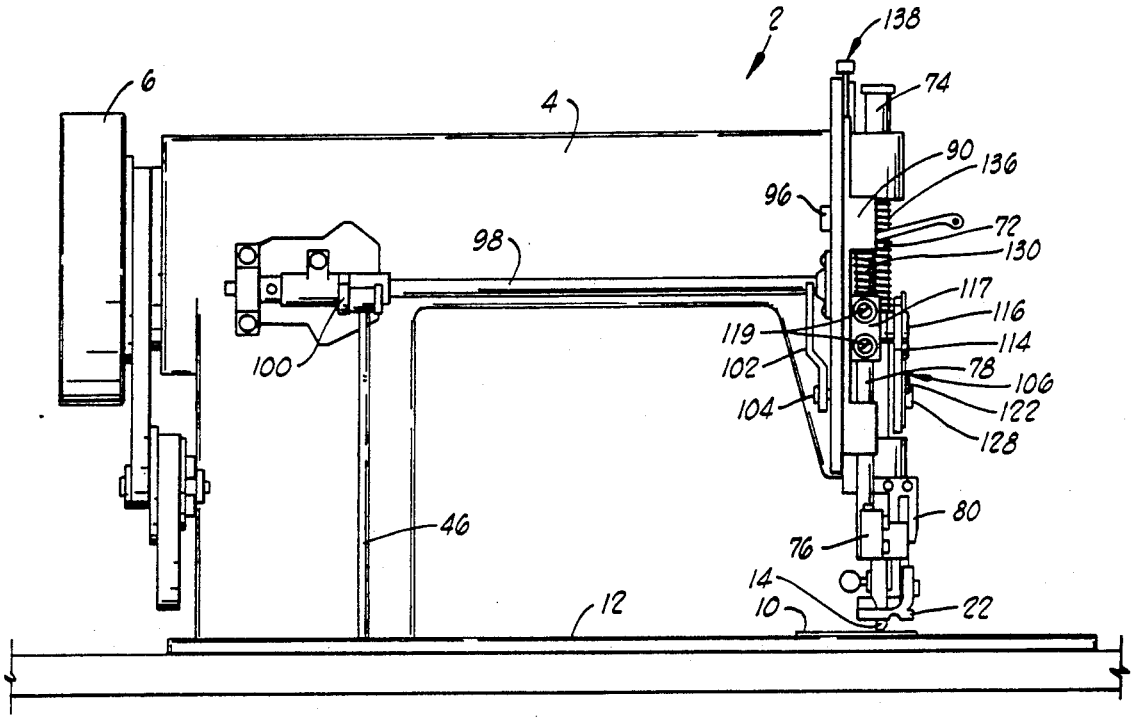
FIG. 1 is a side elevational view of a preferred embodiment of a sewing machine of the present invention.
Figure 2:
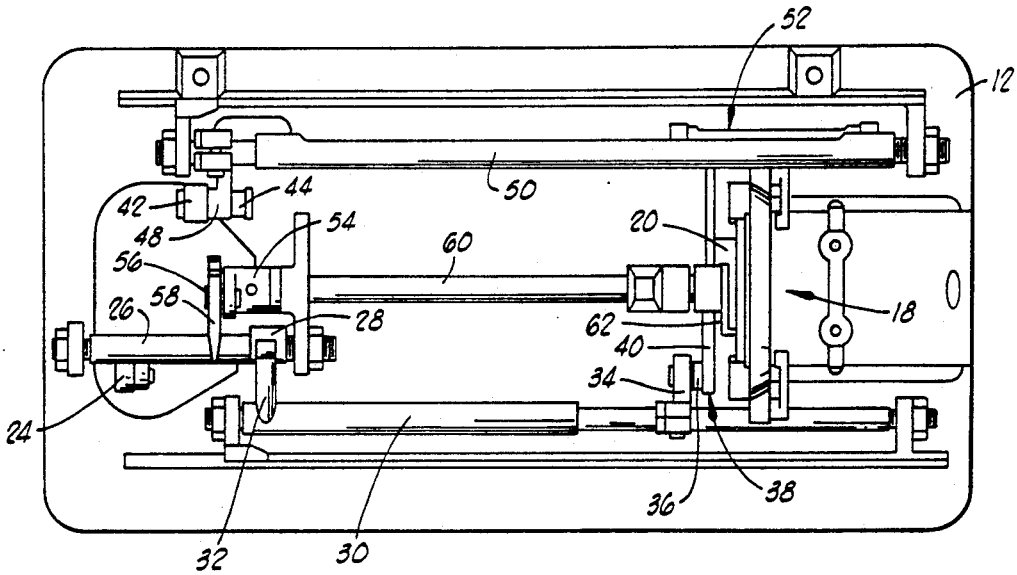
FIG. 2 is a view of the underside of the preferred embodiment sewing machine of the present invention.

Initially referring to FIGS. 1 and 2, a sewing machine 2 of the present invention includes a housing 4. Contained within the housing 4 is a main crankshaft which is coupled to a primary lift shaft and a primary feed shaft as known in the art. A crankshaft drive wheel 6 is connected to one end of the main crankshaft for coupling either manual or powered drive to the main crankshaft. The primary lift shaft and the primary feed shaft are coupled to the main crankshaft so that they are moved by the main crankshaft in a predetermined relationship to provide basic timed drive power to other sewing machine elements. In the embodiment of the sewing machine 2 shown in the drawings, sewing can be done in either a forward direction or a reverse direction as controlled by a lever 8 shown in FIG. 3, which type of operation is known in the art.

During either forward or reverse operation, a presser foot 14 holds a workpiece in place against a workpiece supporting surface 10 of a base 12 of the sewing machine 2 while a needle 16 (FIGS. 1, 3 and 4) stitches in cooperation with a hook-and-bobbin mechanism 18 (FIG. 2). After a stitch has been made, a feed dog 20 (FIG. 2) and a feed foot 22 (FIGS. 1, 3 and 4) engage the workpiece and advance it underneath the raised presser foot 14 and needle 16. The operation of the feed dog 20 and the hook-and-bobbin mechanism 18 are similar to what I have disclosed in my prior patents; therefore, I will describe these only briefly with reference to FIG. 2.

The feed dog 20 is raised and lowered in response to movement by the primary lift shaft and is moved in a forward feed direction and a reverse feed direction by movement of the primary feed shaft. The end of the primary lift shaft is identified in FIG. 2 by the reference numeral 24. The end 24 of the primary lift shaft is connected to a cam shaft 26 which carries a cam 28. Movement of the primary lift shaft oscillates the ca 28 which in turn oscillates a mounting shaft 30 operably connected to the cam 28 by a mounting shaft crank arm 32. A feed dog elevation crank 34 is also connected to the shaft 30. The crank 34 carries a rotatable sleeve 36 which is received inside a forked end 38 of a feed dog support arm 40 to which the feed dog 20 is connected.

The primary feed shaft has an end 42 shown in FIG. 2. The end 42 is coupled to an end 44 of a feed rod 46 (FIG. 1) and to a feed dog feed direction shaft crank 48. The feed dog feed direction shaft crank 48 is connected to a feed direction shaft 50. The feed direction shaft 50 is pivotally connected to the feed dog support arm 40 at a coupling 52 so that oscillation of the shaft 50 imparted from the primary feed shaft oscillates the feed dog 20 through its advancement and return during a workpiece direction of movement cycle.

Still referring to FIG. 2, the hook-and-bobbin mechanism 18 contains a hook for catching thread fed by the needle 16 and for looping or throwing the thread around a bobbin of the mechanism. The mechanism 18 includes a hook throw crank 54 which carries a rotatable block 56. The block 56 is received in a forked extension 58 projecting from the cam shaft 26 driven by the primary lift shaft. Movement of the crank 54 effects oscillatory rotation of a hook throw rod 60 and a throw arm 62 connected thereto.

Each of the previously described shafts shown in FIG. 2 is journaled in appropriate bearing structures which extend from the base 12.

The operation of the foregoing elements shown in FIG. 2 is known in the art.

Figure 3:
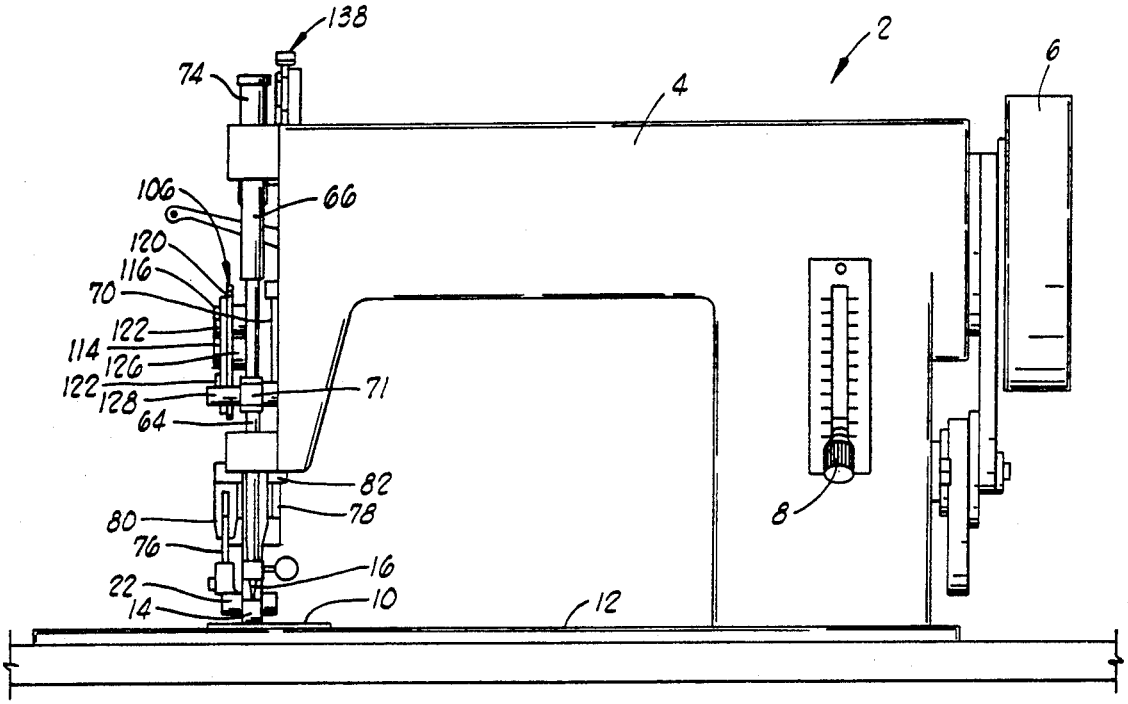
FIG. 3 is another side elevational view of the preferred embodiment sewing machine of the present invention.
Figure 4:
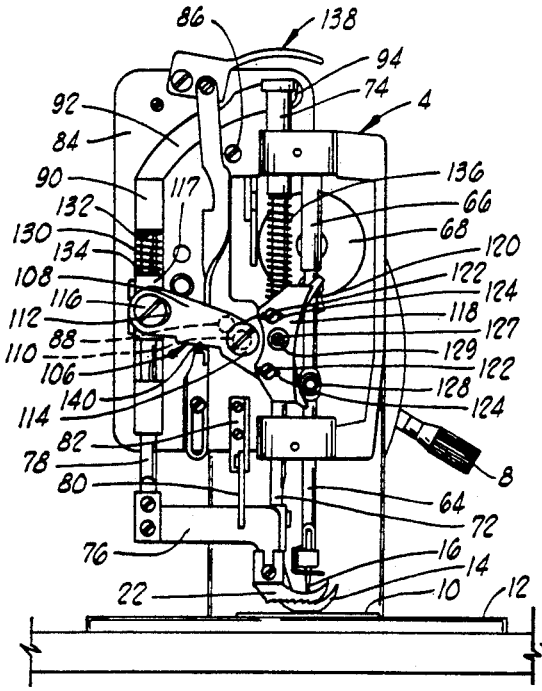
FIG. 4 is an end elevational view of the preferred embodiment sewing machine showing a preferred embodiment of the attachment apparatus of the present invention in a first position.

Referring next primarily to FIG. 4, the needle 16 is connected to a needle bar 64 telescopically received in a sleeve 66 connected to the housing 4. The needle bar 64 and the depending needle 16 are vertically reciprocated by a wheel-and-arm assembly including a wheel 68 and an arm 70 (FIG. 3). The wheel 68 is driven by the main crankshaft. The arm 70 is pivotally connected at one end to the wheel 68 and pivotally connected at its other end to a collar 71 attached to the needle bar 64.

The presser foot 14 is connected to a presser foot bar 72 telescopically received in a sleeve 74 connected to the housing 4. The presser foot bar 72 is mounted parallel to the needle bar 64 as shown in FIG. 4.

The feed foot 22 is connected by an ankle member 76 to a feed foot bar 78. The feed foot 22 has a substantially U-shaped configuration movably disposed around a substantial portion of the periphery of the presser foot 14. Alignment of the feed foot 22 is maintained by alignment fingers 80 connected by a bracket 82 to a support frame 84 connected by screws 86, 88 to the housing 4.

Also mounted on the frame 84 is a tubular member 90 from which an arcuate flange 92 extends to a pivoted connection with a screw 94 which is substantially aligned with the presser foot bar 72 a shown in FIG. 4. The upper end of the tubular member 90 is also retained from behind by a screw 96 shown in FIG. 1. Slidably or telescopically received within the tubular member 90 is the feed foot bar 78.

The feed foot assembly comprising the feed foot bar 78, the ankle member 76 and the feed foot 22 is oscillated through the workpiece direction of movement cycle in response to the operation of the following elements which oscillate the tubular member 90 back and forth about the pivot point defined by the screw 94. These elements are shown in FIG. 1. These include a shaft 98 having one end connected by a crank 100 to the feed rod 46. The other end of the shaft 98 is connected by a crank 102 and a pin 104 to the tubular member 90. The pin 104 passes through a slot in the frame 84. A slot in the frame 84 also accommodates the screw 96. The shaft 98 is journaled at its end containing the crank 100 to the housing 4, and it is journaled at its other end to the frame 84. Thus, in response to operation of the primary feed shaft having the end 42 shown in FIG. 2, the linkage provided by the elements 46, 100, 98, 102, 104 laterally oscillates the tubular member 90 and the feed foot assembly supported thereby.

The present invention also pertains to a subcombination apparatus for synchronizing the lifting movements of the feed foot bar 78 and the presser foot bar 72 (and thus the lifting movements of the respectively attached feed foot 22 and presser foot 14) with the reciprocating movement of the needle bar 64 (and thus its connected needle 16). Referring to FIG. 4, this synchronizing apparatus includes a double-lever lift body 106 connected to the feed foot bar 78 and the presser foot bar 72. The body 106 of the preferred embodiment includes a linkage member 108 having a central aperture 110 and an end slot 112. The aperture 110 is a circular hole in the preferred embodiment having a diameter sufficient to receive the shaft of a retaining screw 114 so that the linkage member 108 pivots about the shaft of the screw 114 but does not significantly shift laterally thereto. The end slot 112, on the other hand, is shaped to permit the linkage member 108 to both pivot and move laterally relative to a retaining screw 116 connected to a collar 117 adjustably attached to the feed foot bar 78 by set screws 119. Lateral movement is needed to accommodate the lateral oscillating movement of the tubular member 90 during the workpiece direction of movement cycle.

The lift body 106 also includes in the preferred embodiment an arcuate guide member 118 having an arcuate edge surface 120. The guide member 118 is adjustably connected to the linkage member 108 by screws 122 connected to the linkage member 108 through slots 124 defined through the member 118.

The overall lift body 106 is shaped and connected to the feed foot bar 78 and the presser foot bar 72 so that the arcuate edge surface 120 is adjacent the needle bar 64. The arcuate edge 120 is parallel to and at its ends overlaps the needle bar 64 as shown in FIG. 4. Although this general disposition should be retained, adjustments can be made using the guide member retaining screws 122, the presser bar collar retaining screw 127 and/or the feed foot collar retaining screws 119. These screws are easily accessible as is the overall lift body 106 due to external mounting on the outside of the needle bar 64, the presser foot bar 72 and the feed foot bar 78.

The screw 114 received through the aperture 110 defined in the lift body 106 connects to a collar 126 (FIG. 3) attached to and extending from the presser foot bar 72. The collar 126 is adjustably attached to the presser foot bar 72 by the set screw 127. Access to the screw 127 is through a hole 129 defined in the guide member 118 portion of the lift body 106. The screw 114 provides a fulcrum about which the lift body 106 is pivotable. The lift body 106 is retained to the feed foot bar 78 by the screw 116 received through the slot 112. The screw 116 provides a fulcrum about which the lift body 106 is both pivotable and slidable.

The thus connected lift body 106 is actuated by actuator means connected to the needle bar 64 so that the lift body 106 moves in response to reciprocation of the needle bar 64. In the preferred embodiment the actuator means includes a roller 128 journaled to the needle bar 64. In the preferred embodiment the roller 128 is pivotally connected to the collar 71 to which the drive arm 70 is connected. The roller 128 vertically reciprocates with the needle bar 64 and rides along the arcuate edge surface 120 to pivot the lift body 106 alternately about the fulcrums provided by the screws 114, 116 and thereby alternately lift the feed foot bar 78 and the presser foot bar 72. As will be further described hereinbelow, when the roller 128 engages the lower end of the arcuate surface 120, the lift body 106 is pivoted clockwise about the screw 114 to lift the feed foot bar 78. When the roller 128 engages the other end of the arcuate surface 120, the lift body 106 is pivoted counterclockwise about the screw 116 to lift the presser foot bar 72.

The foregoing synchronizing apparatus can be retrofit or otherwise adapted to be connected to a suitable pre-existing sewing machine. It can also be part of a newly constructed machine.

Although the aforementioned synchronizing apparatus has been described with reference to lifting the feed foot bar 78 and the presser foot bar 72, it conversely releases each for downward movement during appropriate portions of a stitching cycle. To ensure that the feed foot bar 78 and the pressure foot bar 72 move downward and apply a sufficient holding force, biasing means are provided for each. These include a spring 130 received on the feed foot bar 78 and retained between an upper retaining shoulder 132 of the tubular member 90 and a lower supporting shoulder 134 on the collar 117 attached to the feed foot bar 78. The biasing means for the presser foot bar 72 includes a spring 136 received on the presser foot bar 72 and retained between the sleeve 74 and the screw 114-receiving colar 126. The spring 136 biases the presser foot bar 72 so that the presser foot bar 72 and its connected presser foot 14 are in a lowered position when the roller 124 engages the lower end of the arcuate surface 120 to lift the feed foot bar 78. Conversely, the biasing means for the feed foot bar 78 biases it so that the feed foot bar 78 and its connected feed foot 22 are in a lowered position when the roller 128 engages the upper end of the arcuate surface 120 to lift the presser foot bar 72.

A manual lift mechanism 138 is slidably connected to the frame 84. The mechanism 138 has a protruding shoulder 140 which engages a rearwardly extending (as viewed in FIG. 4) tab (not shown) of the lift body 106 to lift both the presser foot 14 and the feed foot 22 when the lever at the top of the mechanism 138 shown in FIG. 4 is raised.

The operation of the synchronizing apparatus will be described with reference to FIGS. 4–7 which show four different positions of the needle bar 64 during a stitching cycle. During a stitching cycle, the feed dog 20 and the feed foot 22 are oscillated through their workpiece direction of movement cycle. These occur in response to one rotation of the main crankshaft as translated through the wheel 68 and arm 70 assembly and the primary lift and feed shafts.

In FIG. 4, the needle bar 64 and the needle 16 are at there lowermost positions. The feed foot 22 and the feed dog 20 are apart, and the presser foot 14 is down to press and hold the workpiece against the workpiece support surface 10. The feed dog 20 has been lowered by the primary lift shaft acting through the elements 26, 28, 32, 30, 34, 36, 38 shown in FIG. 2. The feed foot 22 has been raised by the roller 128 acting against the lower end of the arcuate surface 120 to pivot the lift body 106 clockwise about the fulcrum provided by the screw 114.

Figure 5:
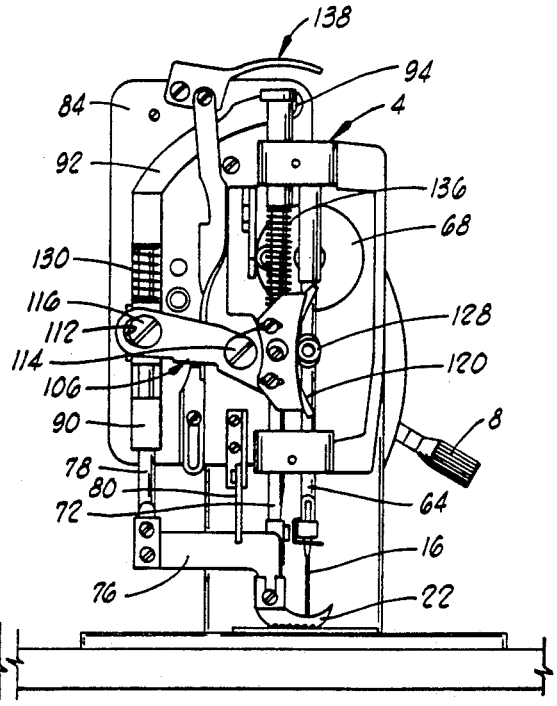
FIG. 5 is an end elevational view of the preferred embodiment sewing machine showing the preferred embodiment attachment apparatus of the present invention in a second position.

As the wheel-and-arm assembly rotates clockwise from the FIG. 4 position to the FIG. 5 position, the feed dog 20 is moved laterally towards the right as viewed in FIG. 5 by the primary feed shaft acting through the members 48, 50, 52 shown in FIG. 2, and the feed foot 22 is moved in the same direction by the primary feed shaft acting through the elements 46, 100, 98, 102, 104, 90 shown in FIG. 1. The feed foot 22 is lowered as the roller 128 moves up to the center of the cam track provided by the arcuate surface 120. This effectively releases the lift body 106, thereby allowing the spring 130 to push the feed foot bar 78 and the feed foot 22 down. This rotates the lift body 106 counterclockwise about the screw 114.

Figure 6:
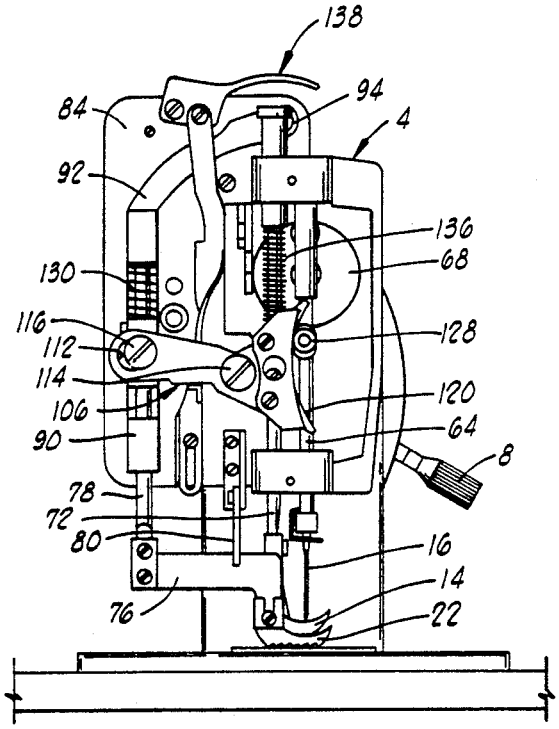
FIG. 6 is an end elevational view of the preferred embodiment sewing machine showing the preferred embodiment attachment apparatus of the present invention in a third position.

As the wheel-and-arm assembly rotates clockwise from the FIG. 5 position to the FIG. 6 position, the feed dog 20 is moved up in response to the primary lift shaft operating through the linkage established by the previously described elements in the lower portion of FIG. 2. The presser foot 14 is raised during this portion of the cycle because the roller 128 moves up the cam track to the upper end of the arcuate surface 120 to pivot the lift body 106 counterclockwise about the left-hand fulcrum provided by the screw 116. This pivotation lifts the presser foot bar 7 connected to the lift body 106 by the screw 114 and the collar 126.

Figure 7:
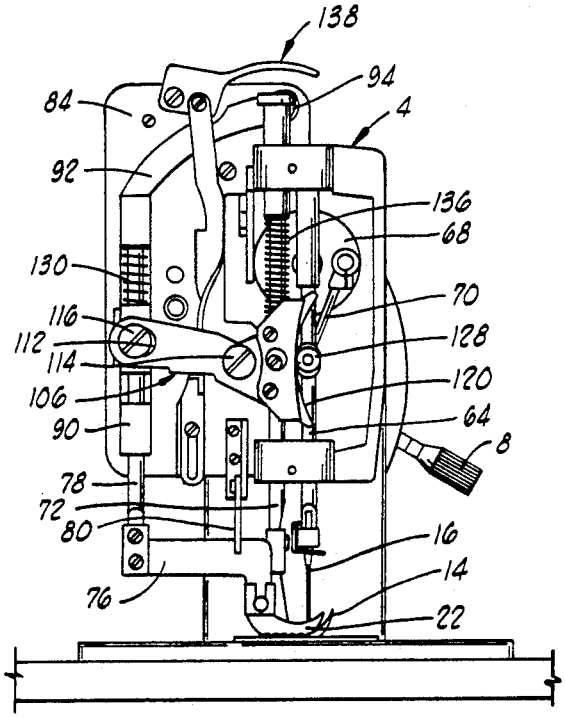
FIG. 7 is an end elevational view of the preferred embodiment sewing machine showing the preferred embodiment attachment apparatus of the present invention in a fourth position.

As the wheel-and-arm assembly moves clockwise from the FIG. 6 position to the FIG. 7 position, the feed dog 20 and the feed foot 22 are moved laterally to the left as viewed in FIG. 7 to advance the workpiece. This movement is achieved by the actions imparted by the primary feed shaft connected through its end 42 to the elements previously described with reference to FIGS. 1 and 2. At the end of this advancement, the roller 128 has returned to its center position to allow the presser foot bar 72 and the presser foot 14 to be lowered by the biasing of the spring 136 so that the presser foot 14 holds the workpiece as the needle 16 enters it to begin forming a stitch. The feed foot 22 is held down by the spring 130.

Continued clockwise movement of the wheel-and-arm assembly from the FIG. 7 position returns the components to the FIG. 4 position wherein the stitch is continuing to be made and the feed dog 20 and the feed foot 22 are separated in preparation of being returned to grip and advance the workpiece after the needle 16 completes its stitch and is extracted from the workpiece.

Thus, the present invention is well adapted to carry out the objects and attain the ends and advantages mentioned above as well as those inherent therein. While a preferred embodiment of the invention has been described for the purpose of this disclosure, changes in the construction and arrangement of parts can be made by those skilled in the art, which changes are encompassed within the spirit of this invention as defined by the appended claims.

What is claimed is:

1. An apparatus for attachment to a sewing machine having a needle bar, a presser foot bar and a feed foot bar, comprising:
   - a lift body including a guide member;
   - means for pivotally connecting said lift body to the presser foot bar and the feed foot bar so that said guide member is adjacent the needle bar; and
   - actuator means directly connected to the needle bar, for actuating said lift body in response to reciprocation of the needle bar.

2. The apparatus of claim 1, further comprising biasing means for biasing the feed foot bar downward.

3. The apparatus of claim 1, wherein:
   - said guide member has an arcuate edge; and
   - said actuator mean includes a roller which engages said arcuate edge during vertical reciprocation of the needle when said apparatus is attached to the sewing machine.

4. The apparatus of claim 1, wherein said lift body further includes:
   - a linkage member adapted to be connected to the presser foot bar and the feed foot bar; and
   - means for adjustably connecting said guide member to said linkage member.

5. An apparatus for synchronizing movements of a presser foot bar and a feed foot bar of a sewing machine with movement of a needle bar of the sewing machine, comprising:
   - a double-lever body having defined therein:
     - a central aperture for receiving a retaining screw to attach said body to the presser foot bar and to define a first fulcrum;
     - an end slot for receiving a retaining screw to slidably attach said body to the feed foot bar and to define a second fulcrum; and
     - a guide; and
     - a roller connected to the needle bar so that said roller vertically reciprocates with the needle bar and rides along said guide of said double-lever body to pivot said double-lever body alternately about the first and second fulcrums and thereby alternately lift the feed foot bar and the presser foot bar.

6. The apparatus of claim 5, further comprising biasing means for biasing the feed foot bar.

7. The apparatus of claim 5, wherein said double-lever body
   - a linkage member having said central aperture and said end slot defined therein;
   - an arcuate member having said guide defined therein; and
   - means for connecting said arcuate member to said linkage member.

8. A sewing machine, comprising:
   - a needle bar;
   - means for reciprocating said needle bar;
   - a feed foot bar;
   - means for oscillating said feed foot bar;
   - a presser foot bar; and
   - means for synchronizing movements of said feed foot bar and said presser foot bar with the reciprocation of said needle bar, said synchronizing means including:
     - a lift body connected to said feed foot bar and said presser foot bar; and
     - actuator means, directly connected to said needle bar, for actuating said lift body in response to reciprocation of said needle bar.

9. The sewing machine of claim 8, wherein said actuator means includes a roller connected to said needle bar.

10. The sewing machine of claim 9, wherein said lift body includes a arcuate edge engaged by said roller during reciprocation of said needle bar.

11. The sewing machine of claim 10, wherein said lift body further includes:
   - a linkage member connected to said feed foot bar and said presser foot bar;
   - a guide member having said arcuate edge; and
   - means for adjustably connecting said guide member to said linkage member.

12. The sewing machine of claim 8, wherein:
   - said lift body has a central aperture and an end slot defined therein; and
   - said synchronizing means further includes:
     - means for connecting said lift body to said presser foot bar, including a first fulcrum disposed through said central aperture of said lift body so that said lift body is pivotable about said first fulcrum; and
     - means for connecting said lift body to said feed foot bar, including a second fulcrum disposed through said end slot of said lift body so that said lift body is pivotable and slidable about said second fulcrum.

13. The sewing machine of claim 12, wherein said lift body also has a surface engaged by said actuator means so that in response to said actuator means engaging said surface at one end thereof said lift body is pivoted about said first fulcrum to lift said feed foot bar and so that in response to said actuator means engaging said surface at another end thereof said lift body is pivoted about said second fulcrum to lift said presser foot bar.

14. The sewing machine of claim 13, wherein said lift body includes a guide member having an arcuate edge defining said surface engaged by said actuator means.

15. The sewing machine of claim 14, wherein said lift body further includes:

a linkage member having said central aperture and said end slot defined therein; and means for connecting said guide member and said linkage member.

16. The sewing machine of claim 15, wherein said actuator means includes a roller connected to said needle bar.

17. The sewing machine of claim 13, further comprising:

means for biasing said presser foot bar so that said presser foot bar is in a lowered position when said actuator means engages said one end of said surface of said lift body; and means for biasing said feed foot bar so that said feed foot bar is in a lowered position when said actuator means engages said another end of said surface of said lift body.

18. The sewing machine of claim 8, further comprising:

a first spring, carried on said presser foot bar above where said lift body is connected to said presser foot bar; and a second spring, carried on said feed foot bar above where said lift body is connected to said feed foot bar.

* * * * *